US006333298B1

(12) United States Patent
Waddoups et al.

(10) Patent No.: US 6,333,298 B1
(45) Date of Patent: Dec. 25, 2001

(54) MOLYBDENUM-FREE LOW VOLATILITY LUBRICATING OIL COMPOSITION

(75) Inventors: Malcolm Waddoups, Westfield; Rolfe J. Hartley, Cranbury, both of NJ (US); Taisuke Miyoshi, Yokohama (JP)

(73) Assignee: Infineum International Limited

( * ) Notice: Subject to any disclaimer, the term of this patent is extended or adjusted under 35 U.S.C. 154(b) by 0 days.

(21) Appl. No.: 09/356,262

(22) Filed: Jul. 16, 1999

(51) Int. Cl.[7] ..... C10M 101/02; C10M 141/12
(52) U.S. Cl. ..... 508/373; 508/399; 508/562
(58) Field of Search ..... 508/373, 399, 508/562

(56) References Cited

U.S. PATENT DOCUMENTS 5,089,156 * 2/1992 Chrisope et al. .
5,360,562 * 11/1994 Chrisope et al. .
5,558,802 * 9/1996 Dowling .
5,578,236 * 11/1996 Srinivasan et al. .
5,789,355 * 8/1998 Adams et al. .
5,891,786 * 4/1999 Srinivasan et al. .
5,935,416 * 8/1999 Cody et al. .
5,935,417 * 8/1999 Cody et al. .
6,059,955 * 5/2000 Cody et al. .
6,074,993 * 6/2000 Waddoups et al. .
6,096,189 * 8/2000 Cody et al. .
6,099,719 * 8/2000 Cody et al. .
6,114,288 * 9/2000 Fujitsu et al. .

FOREIGN PATENT DOCUMENTS

WO97/18278 5/1997 (WO) ..... C10G/47/00
WO98/10041 3/1998 (WO) ..... C10M/105/42
WO99/27041 6/1999 (WO) ..... C10N/159/20

* cited by examiner

*Primary Examiner*—Jerry D. Johnson

(57) ABSTRACT

A molybdenum-free lubricating oil composition exhibiting improved fuel economy and fuel economy retention properties, which comprises: (a) a base stock oil compound of at least 50 wt. % mineral oil, the base stock oil having a viscosity of 4.0–5.5 $mm^2/s$ at 100° C., 95 wt. % or more saturates, 25 wt. % or less napthenics, a NOACK volatility of 15.9% or less, a kV of 4.0–5.5 $mm^2/s$ at 100° C. and a viscosity index of at least 120; (b) at least one calcium detergent and (c) at least one organic friction modifier, wherein the composition has a NOACK volatility of about 15 wt. % or less and contains from about 0.058 to 0.58 wt. % calcium from the calcium detergent.

9 Claims, No Drawings

MOLYBDENUM-FREE LOW VOLATILITY LUBRICATING OIL COMPOSITION

The present invention relates to lubricating oil compositions. More particularly, the present invention relates to lubricating oil compositions, which exhibit improvements in economy and fuel economy retention properties without the need for organo molybdenum additives and which have low volatility.

BACKGROUND OF THE INVENTION

It is well known that molybdenum provides enhanced fuel economy when used in lubricants for gasoline or diesel fueled engines, including both short and long term fuel economy (i.e., fuel economy retention properties). The prior proposals typically use molybdenum at levels greater than 350 ppm up to 2,000 ppm in additive packages, which contain one or more detergents, anti-wear agents, dispersants, friction modifiers, and the like.

The present inventors have found that fuel economy and fuel economy retention properties can be improved to meet the requirements of the next generation of motor oil certification such as the proposed ILSAC GF-3 standards (International Lubricants Standardization and Approval Committee), without the use of molybdenum which is commonly used in conventional additive packages, thus providing a less expensive lubricating oil composition.

SUMMARY OF THE INVENTION

The present invention concerns a lubricating oil composition which exhibits improved fuel economy and fuel economy retention properties, the composition comprising: (a) a major amount of a base stock oil, the base stock oil containing at least 50% by weight of a hydrocarbon mineral oil, the base stock oil having a kinematic viscosity (kV) of 4.0 to 5.5 $mm^2/s$ (cSt) at 100° C., 95 wt. % or more saturates, a viscosity index of at least 120, 25 wt. % or less napthenics (cycloparaffins) and a NOACK volatility of 15.5% or less; (b) a calcium detergent and (c) an organic friction modifier. The composition has a NOACK volatility of about 15 wt. % or less, and contains from about 0.058 to 0.58 wt. % calcium from the calcium detergent and is free of any molybdenum additives. The composition may be prepared by the admixture of the ingredients and such compositions are a further embodiment of this invention.

DESCRIPTION OF THE PREFERRED EMBODIMENTS

Base Stock Oil

The base stock oil should contain 50%–100% by weight of a hydrocarbon mineral oil, such as 70–95 wt. % mineral oil. Blends of hydrocarbon mineral oil and synthetic oils are suitable so long as the base stock oil used to prepare the lubricating oil composition of this invention has these properties: a kinematic viscosity of 4–5.5 $mm^2/s$ (cSt) at 100° C., 95% by weight or more of saturated organic compounds (ASTM D 2007), 25% by weight or less napthenic (cycloparaffinic) hydrocarbons (ASTM D3238), a viscosity index of at least 120 and a NOACK volatility of 15.5 wt. % or less.

Examples of suitable base stocks may be found in one or more of the base stock groups, or mixtures of said base stock groups, set forth in the American Petroleum Institute (API) publication "Engine Oil Licensing and Certification System", Industry Services Department, Fourteenth Edition, December 1996, Addendum 1, December 1998.

a) Group I base stocks contain less than 90 percent saturates and/or greater than 0.03 percent sulfur and have a viscosity index greater than or equal to 80 and less than 120 using the test methods specified in Table A below.
b) Group II base stocks contain greater than or equal to 90 percent saturates and less than or equal to 0.03 percent sulfur and have a viscosity index greater than or equal to 80 and less than 120 using the test methods specified in Table A below.
c) Group III base stocks contain greater than or equal to 90 percent saturates and less than or equal to 0.03 percent sulfur and have a viscosity index greater than or equal to 120 using the test methods specified in Table A below.
d) Group IV base stocks are polyalphaolefins (PAO), a synthetic base stock.
e) Group V base stocks include all other base stocks not included in Groups I, II, III, or IV.

TABLE A

Analytical Methods for Testing Base Stocks

| Property | Test Method |
|---|---|
| Saturates | ASTM D2007 |
| Viscosity Index | ASTM D2270 |
| Sulfur | ASTM D2622, D4292, D4927, or D3120 |
| Napthenics (cycloparaffins) | ASTM D3238 |

Preferred base stock oils are (a) Group III base stocks or blends of Group III base stock oils with Group I, Group II or Group IV base stocks.

Examples of other base stock oils of lubricating viscosity which may be blended with hydrocarbon mineral oils to form the base stock oil useful in this invention include mineral oils and vegetable oils, oils derived from coal and shale, polymerized and interpolymerized olefins such as chlorinated polybutylenes, alkylbenzenes, alkylated polyphenyls, alkylated diphenyl ethers, alkylene oxide polymers, fatty acid esters, polyol esters, oxo acid esters of glycols, esters of dicarboxylic acid with monohydric and polyhydric alcohols such as dibutyl adipate, didecyl phthalate and the like.

Calcium Detergent

The present invention requires the presence of at least one calcium detergent. Detergents aid in reducing deposits that build up in an engine and act as an acid neutralizer or rust inhibitor. This in turn reduces engine wear and corrosion.

The use of a calcium detergent in combination with the base stock oils in the composition of this invention offers fuel economy advantages as demonstrated by coefficient of friction data.

The calcium detergent used in this invention may be neutral or overbased and may comprise calcium phenates, salicylates, sulfonates, or mixtures thereof, with calcium sulfonates being particularly preferred. Preferably, the detergent will be overbased, that is the Total Base Number (TBN) will be at least 100 but usually between 100 and 500, more preferably between 150 and 450, and most preferably between 200 and 400. The most preferred detergent for use in this invention is an overbased calcium sulfonate having a TBN between 200 and 400.

The process of overbasing a metal detergent means that a stoichiometric excess of the metal is present over what is required to neutralized the anion of the salt. It is the excess metal from overbasing that has the effect of neutralizing acids which may build up.

In the present invention, overbased calcium sulfonate detergents may be derived from the salt of an oil soluble sulfonic acid, where a mixture of an oil soluble sulfonate or alkaryl sulfonic acid is combined with calcium and heated to neutralize the sulfonic acid that is present. This forms a dispersed carbonate complex by reacting the excess calcium with carbon dioxide. The sulfonic acids typically are obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene, and chloronaphthalene. The alkylation may be carried out in the presence of a catalyst with alkylating agents having from 3 to more than 30 carbon atoms. For example, haloparaffins, olefins obtained by dehydrogenation of paraffins, or polyolefins produced from ethylene or propylene are all suitable. The alkaryl sulfonates usually contain from about 9 to about 70 or more carbon atoms, preferably from about 16 to about 50 carbon atoms per alkyl substituted aromatic moiety.

The oil soluble sulfonates are neutralized with a calcium compound. The amount of calcium that is used to neutralize the oil soluble sulfonate is carefully chosen with regard to the desired total base number (TBN) of the final product.

In the present invention, the amount of calcium detergents used can vary broadly, but typically will be from about 0.5 to about 5 wt. %, based on the total weight of the composition. This corresponds to about 0.058 to 0.58 wt. % calcium from the calcium detergent in the finished composition. Preferably the composition will contain between about 0.112 to 0.42 wt. % of calcium from the calcium detergent.

Calcium phenates and calcium salicylates may be prepared using a variety of methods well known in the art.

Friction Modifiers

At least one organic oil soluble friction modifier must be incorporated in the lubricating oil composition. Typically, the friction modifier makes up about 0.02 to 2.0 wt. % of the lubricating oil composition. Preferably, from 0.05 to 1.0, more preferably from 0.1 to 0.5 wt. % of the friction modifier is used.

Friction modifiers include such compounds as aliphatic amines or ethoxylated aliphatic amines, aliphatic fatty acid amides, aliphatic carboxylic acids, aliphatic carboxylic esters of polyols such as glycerol esters of fatty acid as exemplified by glycerol oleate, aliphatic carboxylic ester-amides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia.

Representative examples of suitable friction modifiers are found in U.S. Pat. No. 3,933,659 which discloses fatty acid esters and amides; U.S. Pat. No. 4,176,074 which describes molybdenum complexes of polyisobutenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinimide acid and mixtures thereof; U.S. Pat. No. 3,879,306 which discloses N(hydroxyalkyl)alkenyl-succinimic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl)alkenyl succinimides. The disclosures of the above references are herein incorporated by reference. Examples of other friction modifiers are succinate esters, or metal salts thereof, of hydrocarbyl substituted succinic acids or anhydrides and thiobisalkanols such as described in U.S. Pat. No. 4,344,853.

Examples of nitrogen containing friction modifiers, which are a preferred category, include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, and the like.

Such friction modifiers can contain hydrocarbyl groups that can be selected from straight chain, branched chain or aromatic hydrocarbyl groups or admixtures thereof, and may be saturated or unsaturated. Hydrocarbyl groups are predominantly composed of carbon and hydrogen but may contain one or more hetero atoms such as sulfur or oxygen. Preferred hydrocarbyl groups range from 12 to 25 carbon atoms and may be saturated or unsaturated. More preferred are those with linear hydrocarbyl groups.

Preferred friction modifiers include amides of polyamines. Such compounds can have hydrocarbyl groups that are linear, either saturated or unsaturated or a mixture thereof and contain 12 to 25 carbon atoms.

Particularly preferred friction modifiers are alkoxylated amines and alkoxylated ether amines, with alkoxylated amines containing about two moles of alkylene oxide per mole of nitrogen being the most preferred. Such compounds can have hydrocarbyl groups that are linear, either saturated, unsaturated or a mixture thereof. They contain 12 to 25 carbon atoms and may contain one or more hetero atoms in the hydrocarbyl chain. Ethoxylated amines and ethoxylated ether amines are especially preferred, such as ethoxylated tallow amine.

The amines and amides may be used as such or in the form of an adduct or reaction product with a boron compound such as a boric oxide, boron halide, metaborate, boric acid or a mono-, di- or tri-alkyl borate.

Zinc dihydrocarbyldithiophosphate may be added to the lubricating oil composition. Preferably zinc dialkylthiophosphate (ZDDP) is used. This provides antioxidant and antiwear properties to the lubricating composition. Such compounds may be prepared in accordance with known techniques by first forming a dithiophosphoric acid, usually by reaction of an alcohol or a phenol with $P_2S_5$ and then neutralizing the dithiophosphoric acid with a suitable zinc compound. Mixtures of alcohols may be used including mixtures of primary and secondary alcohols. Examples of such alcohols include, but are not restricted to the following list: iso-propanol, iso-octanol, 2-butanol, methyl isobutyl carbinol (4-methyl-1-pentane-2-ol), 1-pentanol, 2-methyl butanol, and 2-methyl-1-propanol. The zinc dihydrocarbyldithiophosphate compound can be a primary zinc, secondary zinc, or mixtures thereof, that is, the zinc compound contains primary and/or secondary alkyl groups derived from primary or secondary alcohols. The alkyl groups can have 1 to 25 carbons, preferably 3 to 12 carbons. Moreover, when employed, there is preferably at least about 50 wt. % secondary zinc from a dihydrocarbyldithiophosphate compound in the zinc dihydrocarbyldithiophosphate compound.

Also, the lubricating oil composition should have a low phosphorus content, that is, the phosphorus from any zinc dihydrocarbyldithiophosphate present should be present in an amount up to about 0.1 wt. %. Preferably, the phosphorus content from the zinc dihydrocarbyldithiophosphate should be from about 0.025 wt. % to about 0.1 wt. %.

Particularly preferred are lubricating oil compositions which contain a ZDDP which is composed of at least 50 wt. % secondary zinc, preferably 75% or more secondary zinc, most preferably 85–100 wt. % secondary zinc, such as a ZDDP having 85% secondary alkyl groups and 15% primary alkyl groups such as a ZDDP made from 85% butan-2-ol and 15% iso-octanol. Amounts are present in the lubricating oil composition to preferably provide a phosphorus content (wt. % P) of up to about 0.1% and preferably 0.025–0.1 wt. % P in the finished oil composition. Such compositions allow for satisfactory results to be obtained in the Sequence IVA engine test for cam wear without the need for more expensive molybdenum containing additives.

It is also necessary that the volatility of the lubricating oil composition, as measured using the NOACK Volatility Test, be about 15 wt. % or less, such as in the range of 4 to 15 wt. %, preferably in the range of 8 to 15 wt. %. The NOACK Volatility Test is used to measure the evaporative loss of an oil after 1 hour at 250° C. according to the procedure of ASTM D5800. The evaporative loss is reported in mass percent.

The compositions can be used in the formulation of crankcase lubricating oils (i.e., passenger car motor oils, heavy duty diesel motor oils, and passenger car diesel oils) for spark-ignited and compression-ignited engines. The additives listed below are typically used in such amounts so as to provide their normal attendant functions. Typical amounts for individual components are also set forth below. All the values listed are stated as mass percent active ingredient.

| ADDITIVE | MASS % (Broad) | MASS % (Preferred) |
|---|---|---|
| Ashless Dispersant | 0.1–20 | 1–10 |
| Other Metal Detergents | 0.1–15 | 0.2–9 |
| Corrosion Inhibitor | 0–5 | 0–1.5 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Other Friction Modifiers | 0–5 | 0–1.5 |
| Viscosity Modifier | 0.01–20 | 0–15 |
| Synthetic and/or Mineral Base Stock | Balance | Balance |

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

Other metal-containing or ash-forming detergents, besides the calcium detergent, may be present and function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Such other known detergents include oil-soluble neutral and overbased, sulfonates, sulfonates, sulfurized phenates, thiophosphonates, and naphthenates and other oil-soluble carboxylates of a metal, particularly the alkali or alkaline earth metals, e.g., sodium, potassium, lithium, and magnesium.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazole derivatives also fall within this class of additives. When these compounds are included in the lubricating composition, they are preferably present in an amount not exceeding 0.2 wt. % active ingredient.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl substituted diphenylamine, alkyl substituted phenyl and naphthylamines, phosphorus esters, metal thiocarbamates, ashless thiocarbamates and oil soluble copper compounds as described in U.S. Pat. No. 4,867,890. Most preferred are the alkyl substituted diphenylamines.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

A small amount of a demulsifying component may be used. A particularly suitable demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Some of the above-mentioned additives can provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate of the present invention is used for blending with the base stock oil having a kinematic viscosity (kV) of 4.0–5.5 $mm^2/s$ (cSt) at 100° C., containing at least 95 wt. % or more saturates, 25% or less napthenics, a viscosity index of at least 120 and a NOACK volatility of 15.5 wt. % or less, the concentrate comprising: (a) at least one calcium detergent and (b) at least one organic friction modifier to provide a lubricating oil composition having a NOACK volatility of about 15 wt. % or less and from about 0.058 to 0.58 wt. % calcium from the calcium detergent, and preferably a zinc dialkyl dithiophosphate in such amounts to provide 0.025 wt. % to 0.1 wt. % P in the finished oil composition.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20 mass %, preferably 4 to 18 mass %, and most preferably about 5 to 17 mass % of the concentrate or additive package, with the remainder being base stock.

This invention also contemplates a method for improving the fuel economy and fuel economy retention properties of an internal combustion engine which comprises the step of adding to the engine the lubricating oil composition of the present invention and operating the engine.

The invention is further illustrated by the following examples which are not to be considered as limitative of its scope.

EXAMPLES

HFRR coefficient of friction tests were carried out in the Oils 1 and 2 shown in the Table below. Friction measurements were made using frequency reciprocating rig (HEFRR). HFRR conditions were:

| | |
|---|---|
| Geometry: | ball on flat |
| Temperature: | 100° C. to 140° C. in 20° C. increments |
| Load: | 10 Newtons |
| Speed: | 2 Hz |
| Stroke: | 1 mm |

Oil 1 represents the invention and Oil 2 is for comparative purposes where overbased TBN 400 magnesium sulfonate was used in place of the overbased TBN 300 calcium sulfonate used in Oil 1. The coefficient of friction data shows the clear advantages in fuel economy resulting from the use of a calcium detergent in accordance with the invention, i.e., use with certain base stocks and with a friction modifier. Oil 2, which has the same base stocks and friction modifiers, but only 0.016% Ca and 0.065% Mg cannot achieve the same low coefficient of friction as are obtained with Oil 1.

TABLE

| | Oil 1 | Oil 2 |
|---|---|---|
| Dispersants | 3.950 | 3.950 |
| Silicone Antifoam | 0.001 | 0.001 |
| Alkoxylated Amine | 0.200 | 0.200 |
| Polyol Ester | 0.200 | 0.200 |
| Nonyl Diphenyl Amine | 0.500 | 0.500 |
| ZDDP (A) | 0.580 | 0.580 |
| ZDDP (B) | 0.580 | 0.580 |
| Group III Base Stock A | 60.014 | 60.177 |
| Group III Base Stock B | 21.086 | 21.143 |
| LOFI | 0.300 | 0.300 |
| VM | 9.050 | 9.150 |
| Ca Sulfonate (TBN 300) | 0.096% Ca | — |
| Ca Phenate (TBN 150) | 0.012% Ca | 0.012% Ca |
| Ca Sulfonate (TBN 16) | 0.004% Ca | 0.004% Ca |
| Mg Sulfonate (TBN 400) | — | 0.065% Mg |
| Diluent/Carrier Oils | Balance | Balance |
| HFRR data - Coefficients of Friction | | |
| at 100° C. | 0.104 | 0.124 |
| at 120° C. | 0.097 | 0.125 |
| at 140° C. | 0.092 | 0.120 |

Notes for Table

1. The dispersants are used as approximately 50% active solution in mineral oil and are polyisobutenyl succinimide dispersants.
2. ZDDP (A) contains 85 mole % secondary alkyl groups and 15% primary alkyl groups.
3. ZDDP (B) contains 100% primary alkyl groups.
4. Group III Base Stock A is a mineral oil having 97.5% saturates, 20.5% napthenics, a VI of 124 and a kV of 4.07 at 100° C. and a NOACK volatility of 14.6%.
5. Group III Base Stock B is a mineral oil having 97.2% saturates, 21.4% napthenics, a VII of 133 and a kV of 6.59 and a NOACK volatility of 6.1%

6. The calcium and magnesium sulfonates and calcium phenate were used in such amounts or as to provide the amount of Ca and Mg as shown in the Table.
7. LOFI is a lube oil flow improver, a 48% solution of a dialkyl fumarate-vinyl acetate copolymer.
8. VM is an olefin copolymer viscosity modifier commercially available as "Paratone 8011".
9. All components are reported as wt. % except where otherwise indicated.

What is claimed is:

1. A lubricating oil composition for internal combustion engines which exhibits improved fuel economy and fuel economy retention properties, is free of molybdenum additives, has a NOACK volatility of 15 wt. % or less and which comprises:

(a) a major amount of a base stock oil which is at least 50 wt. % mineral oil and said base stock oil has a kinematic viscosity of 4.0 to 5.5 $mm^2/s$ at 100° C., 95 wt. % or more saturates, 25 wt. % or less napthenics, a viscosity index of at least 120 and a NOACK volatility of 15.5 wt. % or less;

(b) a calcium sulfonate detergent present in such amounts so as to provide 0.058 to 0.58 wt. % calcium in the composition; and (c) 0.02 to 2.0 wt. % of an oil soluble organic friction modifier.

2. The composition of claim 1 wherein the base stock oil is selected from the group consisting of Group III base stocks, or blends of Group III base stocks with Group I, Group II or Group IV base stocks.

3. The composition of claim 1 wherein the base stock oil further comprises a poly-α-olefin synthetic base stock.

4. The composition of claim 1 wherein the composition further comprises a zinc dialkyl dithiophosphate present in such amount to provide up to 0.1 wt. % phosphorus in the composition.

5. The composition of claim 4 wherein the dialkyldithiophosphate has at least 50 wt. % secondary alkyl groups.

6. The composition of claim 1 wherein the calcium detergent is overbased.

7. The composition of claim 1 wherein the composition further comprises one or more of lubricating oil additives selected from the group consisting of ashless dispersants, other metal detergents, corrsion inhibitors, supplemental antioxidants, pour point depressants, anti-foaming agents, supplemental antiwear agents, other friction modifiers and viscosity modifiers presents in such amounts so as to provide their normal attendant functions.

8. The composition of claim 1 wherein the friction modifier contains nitrogen.

9. The composition of claim 8 wherein the friction modifier is an ethoxylated amine.

* * * * *